United States Patent [19]

Conboy et al.

[11] Patent Number: 4,708,574

[45] Date of Patent: Nov. 24, 1987

[54] APPARATUS FOR HANDLING OBJECTS

[75] Inventors: Stewart J. Conboy, Saint Clair Shores; Robert J. Kish, Flint, both of Mich.

[73] Assignee: D. W. Zimmerman Mfg., Inc., Madison Heights, Mich.

[21] Appl. No.: 751,869

[22] Filed: Jul. 5, 1985

[51] Int. Cl.[4] ..... B66C 1/02

[52] U.S. Cl. ..... 414/591; 294/67.5; 294/95; 403/117; 403/160; 414/626; 414/908

[58] Field of Search ..... 414/591, 626, 908, 910; 242/35.5 A; 294/67.2, 67.5, 95, 97, 103.2; 403/89, 92, 93, 116, 117, 160

[56] References Cited

U.S. PATENT DOCUMENTS

| | | | |
|---|---|---|---|
| 576,204 | 2/1897 | Linn | 403/117 |
| 2,542,038 | 2/1951 | Lewis | 403/160 X |
| 2,925,300 | 2/1960 | Kelley | 294/86.41 |
| 3,115,359 | 12/1963 | Hendrick | 403/93 X |
| 3,325,148 | 6/1967 | Powell | 254/331 |
| 3,734,325 | 5/1973 | Stone | 414/626 |
| 3,933,388 | 1/1976 | Conboy | 294/64.1 X |
| 4,032,185 | 6/1977 | Peyton | 414/626 X |
| 4,138,072 | 2/1979 | Aoyama et al. | 242/35.5 A |
| 4,154,470 | 5/1979 | Dalglish | 414/626 X |
| 4,226,567 | 10/1980 | Van Orsdale, Jr. | 414/917 X |
| 4,320,915 | 3/1982 | Abbott et al. | 414/626 X |
| 4,322,198 | 3/1982 | Zuber | 414/754 |
| 4,488,707 | 12/1984 | Mosley et al. | 403/117 X |
| 4,555,215 | 11/1985 | Raasch et al. | 242/35.5 A |
| 4,557,515 | 12/1985 | Read | 294/67.22 |

FOREIGN PATENT DOCUMENTS

| | | | |
|---|---|---|---|
| 1267296 | 6/1961 | France | 294/95 |

*Primary Examiner*—Robert J. Spar
*Assistant Examiner*—Stuart J. Millman
*Attorney, Agent, or Firm*—Allen D. Gutchess, Jr.

[57] ABSTRACT

Apparatus is provided for handling bobbins and transferring them from one location to another. The apparatus includes upper and lower housings connected by an articulated joint. The upper housing is supported by a fluid-operated, overhead hoist which is controlled by a manually-operated control mounted on the upper housing. The lower housing has an outwardly-extending, compact, fluid-operated gripper which extends into a central passage of the bobbin and has movable jaws engaging the inner surface. The articulated joint enables the lower housing to pivot relative to the upper one and move the gripper between horizontal and vertical positions. The articulated joint has a manually-operated locking pin locking the lower housing in either position, with a manual release handle located near the hoist control on the upper housing to enable both to be manipulated by one hand. The apparatus also includes a fluid interlock system which prevents accidental release of the bobbin from the gripper.

15 Claims, 9 Drawing Figures

APPARATUS FOR HANDLING OBJECTS

This invention relates to apparatus for handling objects and particularly bobbins.

Bobbins or spools of filaments, strands, threads, yarn, roving, and the like which are produced in textile mills often weigh 25 to 30 pounds or more, with some, particularly more recently, being in the order of 100 pounds. Handling such bobbins over the course of a day is tiring for workers. The bobbins may also be mishandled and damaged, particularly by a tired worker, and moisture from the hands may be damaging to the filaments, etc.

The apparatus in accordance with the invention is particularly designed to transfer bobbins to or from creel racks and for placing bobbins into or removing them from cases. When the bobbins are placed onto or removed from pins of the creel rack, the bobbins are in generally horizontal positions. When the bobbins are placed in or removed from the cases, the bobbins are in generally vertical positions. The apparatus includes a bobbin-handling device which is manipulated by a worker and comprises an upper housing and a lower housing which are connected by an articulated joint to enable the lower housing to pivot relative to the upper housing. The lower housing has an outwardly-extending, fluid-operated gripper which is extended into a central passage of the bobbin and has movable jaws which engage the inner surface thereof. With the pivotal movement of the lower housing, the gripper can be moved between a generally horizontal position and a generally vertical position. Thus, the lower housing can be pivoted to move the gripper to the horizontal position when removing a bobbin from or placing it on a creel rack pin. The lower housing can be pivoted to place the gripper in a generally vertical position when placing a bobbin in or removing it from a case.

The bobbin-handling device is supported by a fluid-operated hoist having a cable connected to the upper housing. The fluid-operated hoist is controlled by a manually-operated hoist control mounted on the upper housing. The worker can manipulate this control to raise the device and the bobbin or to lower them. When the control is not actuated by the worker, the bobbin and device can be manually moved up or down over a distance of about a foot with little effort required by the worker. This enables the worker to precisely manipulate the bobbin into the desired position relative to the creel rack pin or the case, for example.

The articulated joint between the upper and lower housings is located on a 45° angle to enable the lower housing to pivot between the horizontal and vertical positions. A locking pin mounted in the upper housing is received in either of two recesses located in a plate of the articulated joint to lock the lower housing in either position. The locking pin is manipulated by a handle mounted on the upper housing near the hoist control to release the pin, as desired. The position of the handle enables the operator or worker to control the hoist and the locking pin with one hand.

The bobbin gripper includes a nose cylinder which is extended into the passage in the bobbin. The cylinder has at least two pivotal jaws therein which extend outwardly beyond the surface of the cylinder to a gripping position and retract into the cylinder to a release position. The jaws are actuated by a compact, fluid-operated ram located within the nose cylinder and having a piston rod and rod member engagable with the jaws to move them between the positions with only a very short movement of the piston. The fluid-operated ram in the cylinder is controlled by a manually-operated gripper valve located on the lower housing and having an unactuated position in which fluid is supplied to one end of the ram to maintain the jaws in the gripping position. The valve has an actuated position in which fluid is supplied to the other end of the ram to move the jaws to the release position. The gripper cylinder is mounted on the lower housing with minimum fasteners so that a different size nose cylinder or other apparatus can be substituted with minimal effort to enable the device to be used with objects of different diameters or sizes.

The apparatus according to the invention also includes a unique interlock system which bypasses the gripper valve to prevent release of a bobbin from the gripper by retraction of the jaws into the cylinder when the pressure in the fluid-operated overhead hoist is at or above a predetermined value. The interlock system includes an adjustable sensing valve by means of which the aforesaid pressure value can be changed to accommodate different weights.

It is, therefore, a principal object of the invention to provide an improved device with an articulated joint for handling bobbins and for moving them between horizontal and vertical positions.

Another object of the invention is to provide a bobbin handling device with an articulated joint having a locking pin for locking a lower housing of the device in either of two positions and a release handle external to an upper housing of the device for releasing the locking pin from the positions.

Still another object of the invention is to provide a bobbin handling device with a gripper having a nose cylinder mounted on a lower housing of the device in a manner to enable quick replacement of the nose cylinder.

Yet another object of the invention is to provide bobbin handling apparatus employing an overhead fluid-operated hoist supporting a bobbin handling device with a fluid-operated gripper and with an interlock system which prevents release of a bobbin held by the gripper when fluid in the hoist is at or above a predetermined pressure.

Many other objects and advantages of the invention will be apparent from the following detailed description of a preferred embodiment thereof, reference being made to the accompanying drawings, in which.

Figures 1, 9:
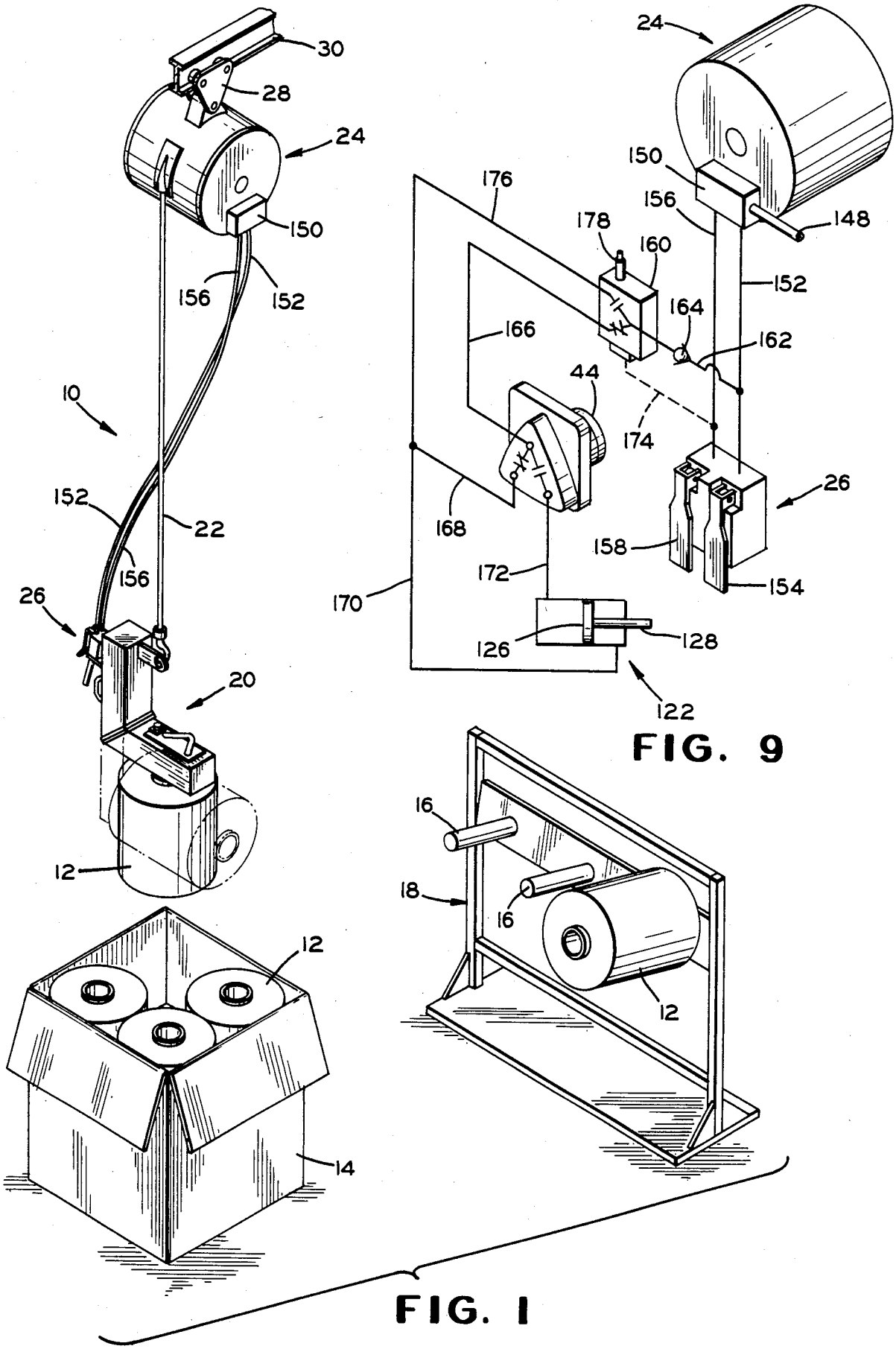
FIG. 1 is a view in perspective of overall bobbin-handling apparatus showing a bobbin suspended in a vertical position in solid lines, for being placed in or removed from a case, and showing a bobbin in a horizontal position in dotted lines, for being placed on or removed from a pin of a creel rack.
FIG. 9 is a diagrammatic view in perspective of a fluid interlock system of the apparatus.

Referring to FIG. 1, the overall bobbin-handling apparatus in accordance with the invention is indicated at 10 and is used to handle and transfer bobbins 12. The bobbins 12 commonly weigh in the order of twenty-five to thirty pounds but, particularly more recently, can weigh in the order of one hundred pounds. Handling hundreds of bobbins over the course of a day can be very tiring to workers. The surfaces of the bobbins can also be damaged if handled by hand and moisture from the hands can cause damage to the filaments, etc. of the bobbins.

As shown, the bobbins 12 are in a generally core vertical disposition when placed into or removed from a case or container 14. The bobbins are in a generally core horizontal position when placed on or removed from pins 16 of a creel rack 18. When the bobbins are moved between the case 14 and the rack 18, the bobbins must be repositioned from the core vertical to the core horizontal position or vice versa. This is accomplished by a bobbin-handling device 20 of the apparatus 10 which is supported through a cable 22 or other elongate member by an overhead, fluid-operated hoist 24. The hoist 24 and a hoist control 26 which is mounted on the device 20 can be of the type shown in U.S. Pat. No. 3,325,148, issued on June 13, 1967. The hoist 24 has a trolley 28 supporting the hoist on an overhead rail 30 which enables the hoist 24 to be moved therealong.

Figure 2:
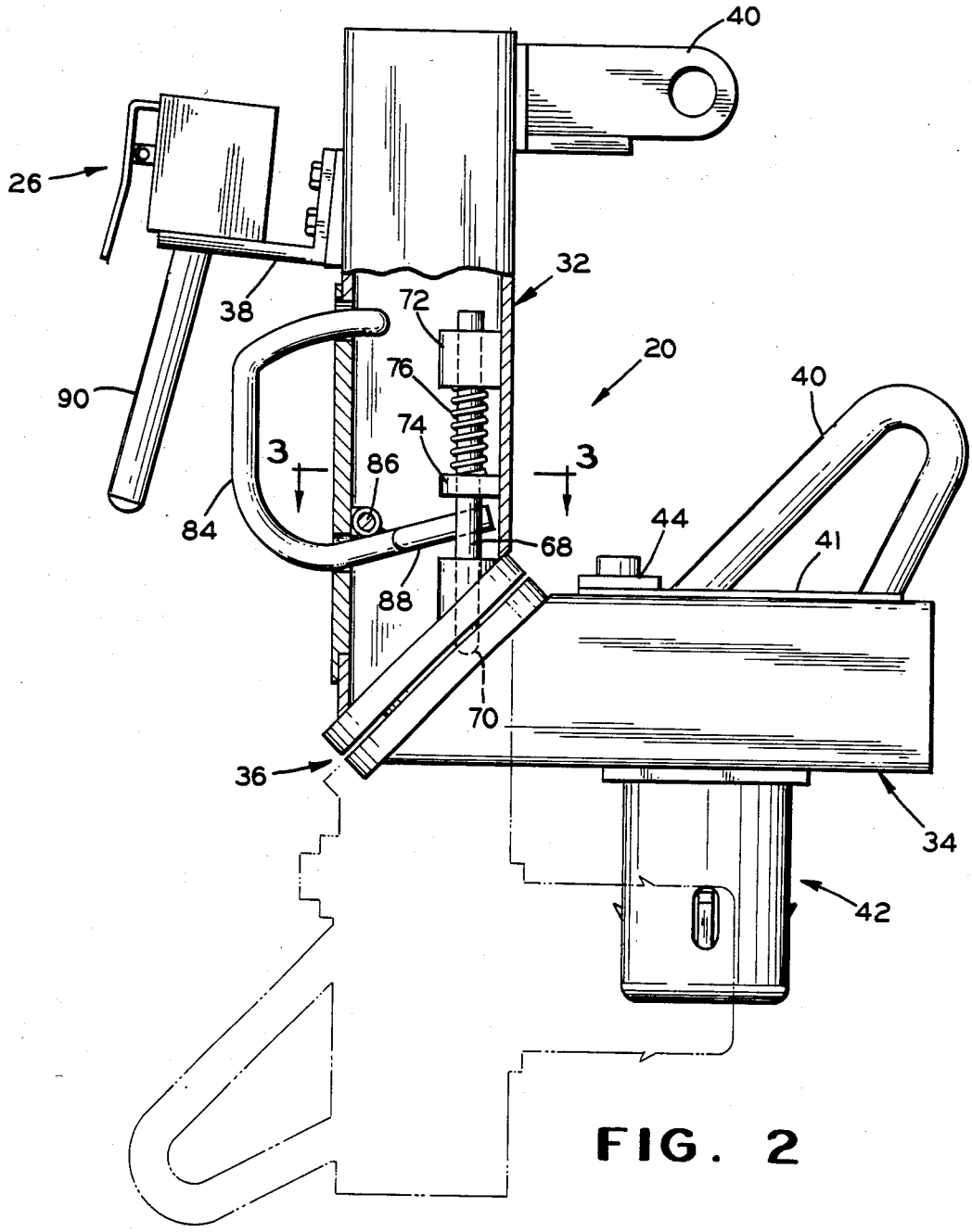
FIG. 2 is a somewhat schematic view in elevation, with parts broken away and with parts in section, of a bobbin handling device, with a lower housing shown in a horizontal position in solid lines and shown in a vertical position in dotted lines.

Referring to FIG. 2, the bobbin-handling device 20 includes an upper housing 32 and a lower housing 34 connected by an articulated joint 36. The upper housing 32 has a bracket 38 upon which the control 26 is mounted and has an upper flange 40 to which the cable 22 is connected.

The lower housing 34 has a handle 40 extending outwardly from a cover plate 41, by means of which the lower housing 34 can be manipulated between horizontal and vertical positions. A bobbin gripper indicated at 42 extends outwardly from the lower housing 34 on the side opposite the handle 40. A gripper valve 44 for operating the gripper 42 is located near the handle 40.

Figure 4:
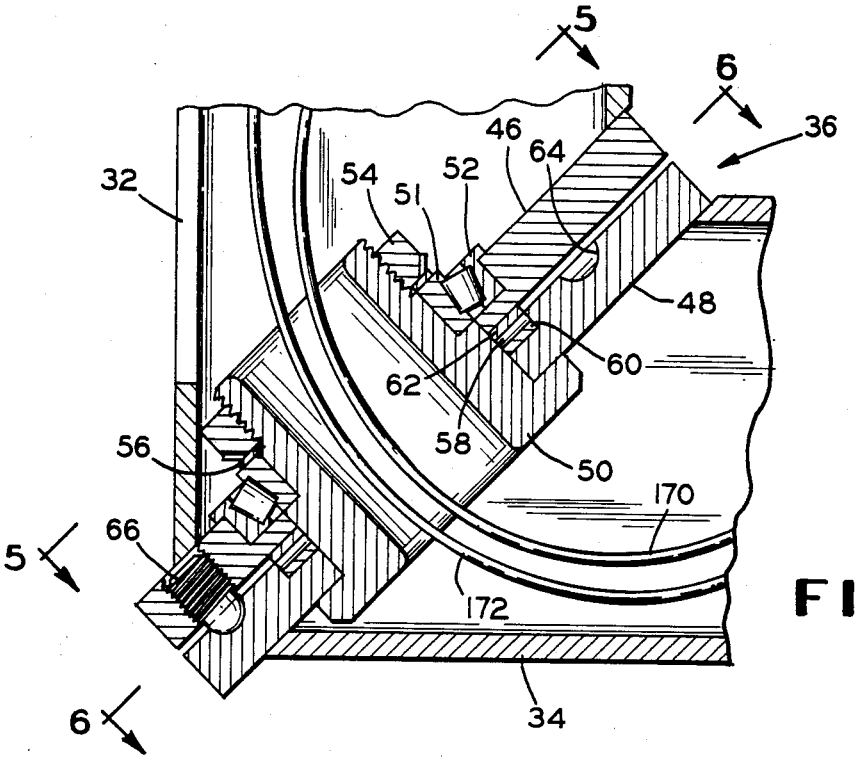
FIG. 4 is an enlarged, fragmentary view in vertical cross section of an articulated joint of the bobbin handling device of FIG. 2.
Figure 5:
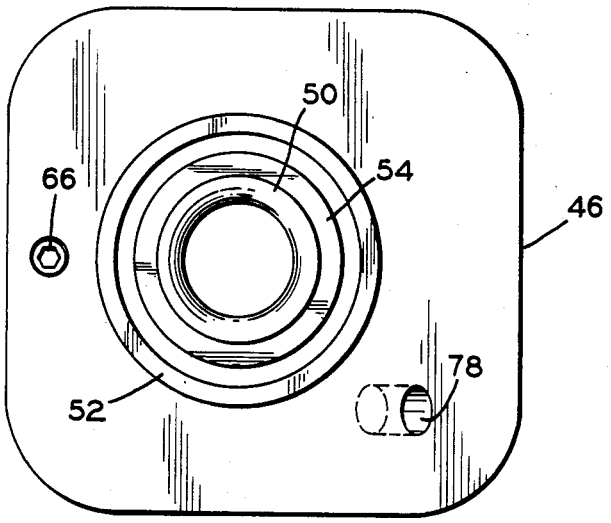
FIG. 5 is a top view of an upper plate of the articulated joint, taken along the line 5—5 of FIG. 4.
Figure 6:
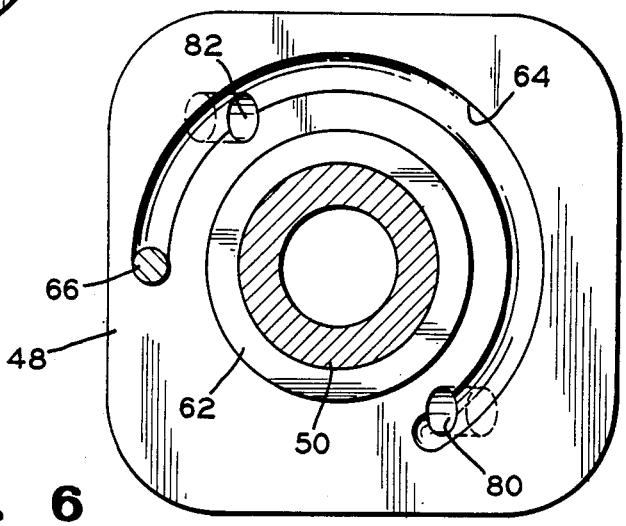
FIG. 6 is a top view of a lower plate of the articulated joint taken along the line 6—6 of FIG. 4.

The articulated joint 36 between the upper and lower housings 32 and 34 is shown more specifically in FIGS. 4–6. The joint 36 includes an upper plate 46 affixed to a lower diagonal end of the upper housing 32 and a lower plate 48 affixed to a diagonal end of the lower housing 34. A trunnion shaft 50 extends through central openings in the plates 46 and 48 and also through a roller bearing cone 51 which rests in a roller bearing flanged cup 52 in the upper plate 46. The head of the trunnion shaft 50 is welded to the lower plate 48 and the upper end receives a lock nut 54 and a lock washer 56. Needle bearings 58 are located between the plates 46 and 48 around the trunnion shaft 50 and between two thrust washers 60 and 62.

The lower plate 48 has an arcuate groove 64 therein having a common center with the axis of the trunnion shaft 50 and extending more than 180° to enable the lower housing 34 to pivot through an arc of more than 180°. A setscrew 66 (FIG. 4) in the upper plate 46 extends into the groove 64 to limit the movement of the lower housing. This limited movement prevents excessive twisting of flexible fluid lines (to be discussed later) extending down to the lower housing 34 through the trunnion shaft 50.

Figure 3:
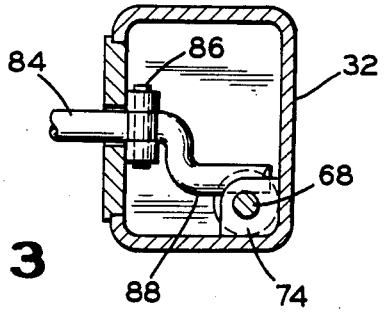
FIG. 3 is a view in horizontal section, taken along the line 3—3 of FIG. 2.

In order to affix the lower housing 34 in either its horizontal or vertical position, a locking pin 68 (FIGS. 2 and 3) with a rounded end 70 is mounted in the upper housing 32, being slidably carried by a guide block 72 at its upper end and having a flange 74 slidably engaging inner surfaces of the housing 32. A coil spring 76 is located between the flange 74 and the block 72 and urges the locking pin 68 downwardly. The lower end 70 of the pin 68 extends through an opening 78 in the plate 46 (FIG. 5) and is urged against an upper surface of the plate 48 adjacent the arcuate groove 64 by the coil spring 76. When the lower housing 34 is in the horizontal position, the end 70 of the locking pin 68 extends into a recess 80 (FIG. 6) in the lower plate 48 to hold the lower housing 34 in the horizontal position. Similarly, when the lower housing 34 is pivoted 180° to the vertical position, the locking pin end 70 extends into a recess 82 to hold the lower housing in the vertical position.

A release handle 84 (FIGS. 2 and 3) is used to raise the locking pin 68 from either of the recesses 80 and 82 in order to enable the lower housing 34 to be pivoted. The release handle 84 has an intermediate portion pivoted by a pin 86 on the interior of the upper housing 32. A lower, inner end of the handle 84 has a release member or offset portion 88 which is positioned below the locking pin flange 74. When the handle 84 is pulled outwardly by the operator, the offset portion 88 forces the flange 74 and the pin 68 upwardly against the force of the spring 76 to release the handle so that the lower housing 34 can be pivoted. The release handle 84 is located near a handle 90 of the bracket 38 so that both the hoist control and the release handle can be readily manipulated by one hand of the worker.

Figure 7:
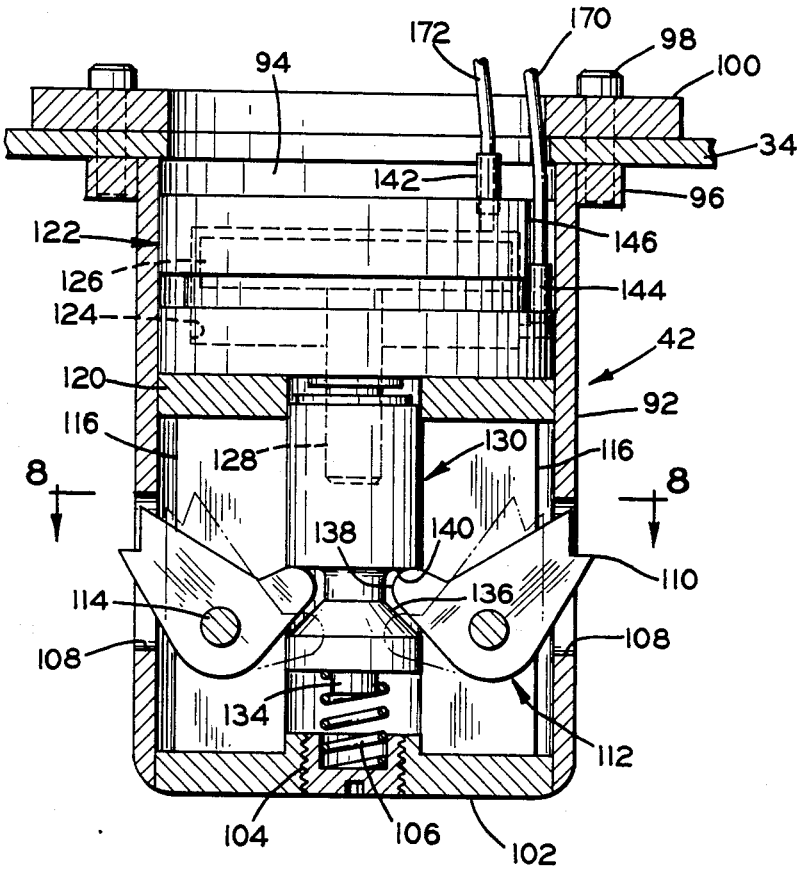
FIG. 7 is a fragmentary view in vertical cross section of a gripper nose cylinder shown in FIG. 2.
Figure 8:
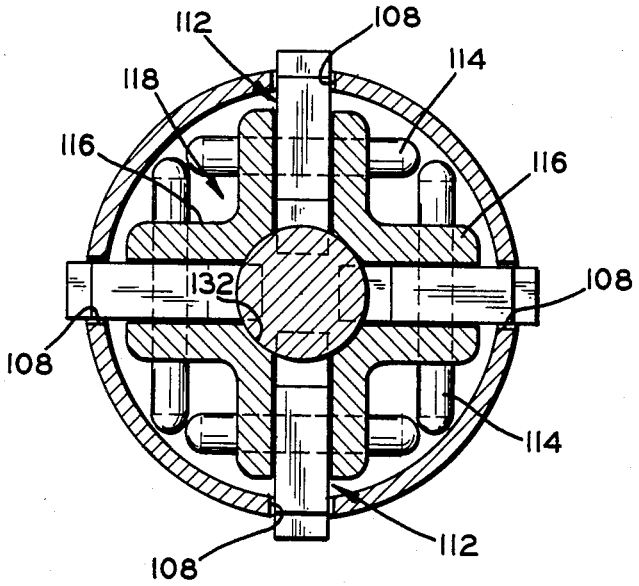
FIG. 8 is a view in transverse cross section taken along the line 8—8 of FIG. 7.

Referring to FIGS. 7 and 8, the bobbin gripper 42 includes a nose cylinder 92. The cylinder 92 has an end plate 94 and a peripheral flange 96 which receives four mounting screws 98 extending through a backing plate 100 inside the housing 34 and also extending through the wall of the housing 34. The nose cylinder 92 can thereby be relaced by removing the four screws 98 when the cover plate 41 on the opposite side of the housing 34 is removed. Two air lines also must be disconnected and reconnected. However, this is a relatively simple operation when nose cylinders of different diameters are required for bobbins of different sizes.

The cylinder 92 also has an outer end plate 102 affixed thereto and carrying a threaded member 104 which forms a seat for one end of a coil spring 106. The nose cylinder 92 has four longitudinally extending slots 108 through which outer edge portions 110 of jaws 112 extend when the jaws are in their outermost or extended positions. The jaw edge portions 110 engage the inner surface of the passage or recess in the bobbin 12. Intermediate portions of the jaws 112 are pivotally supported through pins 114 by legs 116 of a spider 118. The spider 118 also includes a base 120 from which the legs 116 extend.

The base 120 is located adjacent an end of a pneumatic ram 122 which forms a cylinder 124 containing a piston 126 from which a piston rod 128 extends. The piston rod 128 is connected to a rod member 130 which is positioned within a bore 132 (FIG. 8) formed in the spider 118. The rod member 130 has an end projection 134 which forms a seat for the coil spring 106. The rod member also has an annular recess 136 in which are received inner end portions 138 of the jaws 112. The ends 138 are engaged by an annular shoulder 140 on the rod member 130. When air is supplied to the rod end of the cylinder 124, the piston 126 in the cylinder 124 is retracted, and the rod member 130 is in the solid line position of FIG. 7 with the jaw edges 110 extending through the slots 108. When air is supplied to the blind end of the cylinder 124 to move the piston 126 outwardly, the rod member 130 is moved against the force of the spring 106 to move the jaws 112 to the retracted positions, shown in dotted lines in FIG. 7. The cylinder 92 can then be released from the bobbin. The spring 106 maintains the jaws 112 in the gripping or extended position in the event of air failure so that a bobbin will not be dropped if such occurs.

Fluid, such as air, is supplied to the bind end of the cylinder 124 through a fitting 142 and fluid is supplied to the rod end of the cylinder through a fitting 144 extending through a notch 146 in the end of the ram 122. The ram 122 has a stroke of only about one-quarter inch, which is sufficient to move the jaws 112 between their retracted and extended positions. The ram is a commercially available item except for being slightly modified to receive the two fittings 142 and 144 from the end of the nose cylinder 92 through an opening in the housing 34.

The fluid-operating system for the overall apparatus is shown in FIG. 9. Fluid under pressure is supplied through a line 148 to a manifold 150 of the hoist 24. This fluid is supplied through a line 152 to the hand-operated hoist control 26. When an "up" handle 154 is depressed, fluid under pressure is supplied through a line 156 to the manifold 150 and into the hoist chamber of the hoist 24. When the pressure in the hoist chamber is sufficient, the load carried by the bobbin-handling device 20 is raised. When the handle 154 is released, fluid is trapped in the hoist chamber and the pressure in the hoist balances the load. At this time, the load can be raised or lowered in the order of ten or twelve inches because of the compressible nature of the fluid or air. When a "down" lever 158 of the control 26 is depressed, fluid is exhausted through the line 156 from the hoist chamber and the load is lowered until the handle 158 is released. The load again can be manipulated in its new position through a vertical range of ten or twelve inches.

When no load is carried by the device 20, an interlock valve 160 is in the unactuated condition as shown, with fluid under pressure then supplied from the line 152 through a line 162, past a check valve 164, and through the valve 160 to a supply line 166. The push-button, clamp-operating valve 44, when unactuated, communicates with the line 166 and fluid is upplied therethrough to a line 168 and a line 170 to the rod end of the clamping ram 122. The piston 126 and the piston rod 128 are thereby moved toward the left as shown in FIG. 9 to the clamping position.

When the nose cylinder 92 is to be inserted in the spool of a bobbin, the push-button of the valve 44 is depressed, which then supplies fluid from the line 166 through a line 172 to the blind end of the ram 122, moving the piston 126 and the rod 128 toward the right, to the unclamping position. The clamp is then inserted in the spool and the push-button of the valve 44 released to cause the clamping jaws 112, (FIG. 7) to engage the bobbin, with the fluid again supplied through the lines 168 and 170. In practice, the flexible lines 170 and 172 extend from the upper housing 32 to the valve 44 through the trunnion shaft 50 (FIG. 4) of the articulated joint 36.

To raise the bobbin engaged by the device 20, the "up" level 154 is depressed to supply fluid through the lines 152 and 156 to the hoist chamber. The pressure in the line 156 equals that in the hoist chamber and when the bobbin is raised, the pressure in the line 156 is sensed through a line 174 by the interlock valve 160, causing it to shift positions. Fluid is then supplied from the valve 160 through a line 176 and the line 170 to override or bypass the push-button valve 44 and cause the ram 122 to remain in the clamped position regardless of the position of the valve 44. This prevents accidental release of the bobbin when engaged by the grabber 42 and suspended from the hoist cable 22. The pressure at which the interlock valve 160 shifts is controlled by a spring which is adjustable by a threaded adjustment 178, depending upon the size and weight of the apparatus for handling objects.

Various modifications of the above-described embodiment of the invention will be apparent to those skilled in the art and it is to be understood that such modifications can be made without departing from the scope of the invention, if they are within the spirit and the tenor of the accompanying claims.

We claim:

1. Apparatus for handling objects having passages therein, said apparatus comprising an upper housing, a lower housing, a gripper extending outwardly from said lower housing to be received in the passages of the objects, said gripper including a fluid-operated ram for causing said gripper to grip said object in said passage and for causing said gripper to release from said passage, means forming an articulated joint between said housings to enable said lower housing to move relative to said upper housing in a manner to enable said gripper to move between a generally vertical position and a generally horizontal position, an overhead, fluid-operated hoist, an elongate, flexible member extending downwardly from said hoist, said upper housing having means to receive said flexible, elongate member, locking means engagable with said articulated joint to lock said lower housing in either of two positions relative to said upper housing with said gripper in either of the vertical and horizontal positions, release means carried by said upper housing for releasing said locking means, a manually-operable hoist control mounted on said upper housing, a handle on said lower housing on the side opposite said gripper, and manually operated gripper valve on said lower housing adjacent said handle for operating said fluid-operated ram.

2. Apparatus according to claim 1 characterized by said locking means comprising a locking pin movably mounted in said upper housing and two recesses in said articulated joint to receive an end of said locking pin, and said release means comprising a handle having an offset portion engagable with said pin to move said pin to the release position, said handle extending outwardly from said upper housing near said manually-operated hoist control, whereby said hoist control and said handle can be operated by one hand of an operator.

3. Apparatus according to claim 1 characterized by a pressure-responsive valve responsive to pressure of fluid in said hoist and enabling the supply of fluid to said ram independently of said gripper valve to maintain said jaws in a gripping position when the hoist pressure is at a predetermined value or higher, and for supplying fluid to said gripper valve when the hoist pressure is below the predetermined value.

4. Apparatus according to claim 1 characterized by said articulated joint comprising an upper plate affixed to a lower end of said upper housing at a 45° angle to an axis of said upper housing, a lower plate affixed to an end of said lower housing on a 45° angle with respect to an axis of said lower housing, means pivotally connecting said plates, and means cooperating between said plates for limiting the extent of pivotal movement of said lower housing relative to said upper housing.

5. Apparatus according to claim 1 characterized by said gripper comprising a nose cylinder, said fluid-operated ram being in said nose cylinder, flange means on said nose cylinder, fastener means connecting said flange means to said lower housing, said nose cylinder having at least two diametrically disposed slots therein extending longitudinally of the cylinder, a jaw for each of said slots, a spider in said nose cylinder having legs adjacent said jaws, means pivotally connecting said jaws to said spider legs, and a rod member movable by said ram and engagable with said jaws to move said jaws between an extended position extending out of said cylinder slots and a retracted position within said cylinder.

6. Apparatus for handling objects having central passages therein, said apparatus comprising upper and lower housings, a gripper extending outwardly from said lower housing to be received in the central passages of the objects, means forming an articulated joint between said housings to enable said lower housing to move relative to said upper housing in a manner to enable said gripper to move between a generally vertical position and a generally horizontal position, an overhead hoist, means on said upper housing to receive a cable, a cable extending from said hoist and connected to said cable-receiving means, a locking pin movably mounted in said upper housing, said articulated joint having two recesses to receive said pin to lock said lower housing in either of two positions relative to said upper housing, said pin having a locking position in which it is received in one of said recesses and a release position in which it is spaced from said recesses, a release member engagable with said pin to move said pin to the release position, a handle connected to said release member and extending outwardly from said upper housing to operate said release member, and a manually-operable hoist control mounted on said upper housing near said handle, said hoist control having handle means positioned near said release member handle, whereby said hoist control and said handle can be operated by one hand of an operator with his hand on said handle means to manipulate said upper housing.

7. Apparatus according to claim 6 characterized by said locking pin having a flange affixed thereto, said release member being an offset portion of said handle.

8. Apparatus according to claim 6 characterized by spring means engagable with said locking pin for urging said locking pin toward said recesses.

9. Apparatus for handling objects having central passages extending therethrough, said apparatus comprising an upper housing, a lower housing, a gripper extending outwardly from said lower housing to be received in the central passages of the objects, means forming an articulated joint between said housings to enable said lower housing to move relative to said upper housing in a manner to enable said gripper to move between a generally vertical position and a generally horizontal position, an overhead hoist, means on said upper housing to receive a cable, a cable extending from said hoist and connected to said cable-receiving means, a hoist control mounted on said apparatus for controlling the supply of fluid to said hoist, said gripper having at least one jaw with an engagable position for engaging the surfaces of the passages of the objects and a retracted position within said gripper, a fluid-operated ram for moving said jaw between its positions, manually-operated valve means mounted on said lower housing for controlling the supply of fluid to said ram, a pressure-responsive valve responsive to pressure in said hoist and enabling the supply of fluid directly to said ram, bypassing said valve means, to maintain said jaw in a gripping position when said hoist pressure is at a predetermined value or higher, and for supplying fluid to said valve means when said hoist pressure is below the predetermined value, and a gripper handle on said lower housing adjacent said manually-operated valve means.

10. Apparatus according to claim 9 characterized by said pressure-responsive valve having adjustable means for adjusting the predetermined value of the pressure in the hoist at which said pressure-responsive valve is actuated.

11. Apparatus for handling objects of generally cylindrical shape having central passages extending therethrough, said apparatus comprising an upper housing, a lower housing, a gripper extending outwardly from said lower housing to be received in the central passages of the objects, means forming an articulated joint between said housings to enable said lower housing to move relative to said upper housing in a manner to enable said gripper to move between a generally vertical position and a generally horizontal position, a fluid-operated overhead hoist, means on said upper housing to receive a cable, a cable extending from said hoist and connected to said cable-receiving means, a source of fluid under pressure, a manually-operable hoist control communicating with said fluid source and with said hoist, said hoist control having manually-operable means for supplying fluid under pressure to the hoist to raise an object gripped by said gripper and additional manually-operable means for reducing pressure in said hoist to lower an object gripped by said gripper, said gripper having at least one jaw with an engagable position for engaging the surfaces of the passages of the objects and a retracted position within said gripper, a fluid-operated ram for moving said jaw between its positions, a manually-operated gripper valve mounted on said apparatus for causing said gripper jaw to grip an object when said valve is not actuated and for causing said jaw to move to the retracted position within said gripper when said gripper valve is actuated, a gripper handle extending outwardly from said lower housing on the side opposite said gripper, said gripper handle being adjacent said manually-operated gripper valve, and an interlock valve for sensing the pressure of fluid in said hoist for bypassing said gripper valve for supplying said fluid under pressure independently of said gripper valve directly to said fluid-operated ram to prevent release of said gripper by manual operation of said gripper valve when the pressure of fluid in said hoist is at least equal to a predetermined value, and for supplying fluid to said gripper valve when said hoist pressure is below the predetermined value.

12. Apparatus according to claim 11 characterized further by said interlock valve having adjusting means for changing the predetermined value of the pressure of fluid in the hoist at which said interlock valve is actuated.

13. Apparatus for handling objects having central passages therein, said apparatus comprising an upper housing, a lower housing, a gripper extending outwardly from said lower housing to be received in the central passages of the objects, and means forming an articulated joint between said housings to enable said lower housing to move relative to said upper housing in a manner to enable said gripper to move between a generally vertical position and a generally horizontal position, said lower housing having a handle extending outwardly therefrom on the side opposite said gripper, said means forming an articulated joint comprising an upper plate affixed to a lower end of said upper housing at a 45° angle to an axis of said upper housing, a lower plate affixed to an end of said lower housing on a 45° angle with respect to an axis of said lower housing, said plates having central openings therein, a trunnion shaft extending through said openings and connecting said plates in a manner to enable said plates to pivot about an axis of said trunnion shaft relative to one another, one of said plates having an arcuate groove extending at least 180° around said central openings and facing the other of said plates, and a projection carried by the other of said plates and extending into said arcuate groove to limit the extent of movement of said plates relative to one another.

14. Apparatus according to claim 13 characterized by locking means movably carried by said upper housing for engaging said lower plate to lock said lower housing in fixed positions relative to said upper housing, and release means extending out of said upper housing and engagable with said locking means to move said locking means out of engagement with said lower plate.

15. Apparatus for handling objects having central passages therein, said apparatus comprising an upper housing, a lower housing, a fluid-operated gripper extending outwardly from said lower housing to be received in the central passages of the objects, means forming an articulated joint between said housings to enable said lower housing to move relative to said upper housing in a manner to enable said gripper to move between a generally vertical position and a generally horizontal position, said means forming an articulated joint comprising an upper plate affixed to a lower end of said upper housing at an angle to an axis of said upper housing, a lower plate affixed to an end of said lower housing at an angle to an axis of said lower housing, said plates having central openings therein, a trunnion shaft extending through said openings and connecting said plates in a manner to enable said plates to pivot about an axis of said trunnion shaft relative to one another, said trunnion shaft having a passage extending centrally therethrough in a longitudinal direction of said shaft, said plates having cooperating means to limit the extent of movement of said plates relative to one another about the axis of said trunnion shaft, and fluid passage lines extending through said trunnion shaft passage and communicating with said fluid-operated gripper for supplying fluid to said gripper for operating same.

* * * * *

UNITED STATES PATENT OFFICE

CERTIFICATE OF CORRECTION

Patent No. 4,708,574 Dated Nov. 24, 1987

Inventor(s) Stewart J. Conboy and Robert J. Kish

It is certified that error appears in the above-identified patent and that said Letters Patent are hereby corrected as shown below:

In the specification:

Column 5, line 17, "bind" should be --blind--.

Column 5, line 53, "upplied" should be --supplied--.

Column 6, line 4, "level" should be --lever--.

In the claims:

Claim 1, line 23, "and manually operated" should be --and a manually-operated--.

Signed and Sealed this

Nineteenth Day of April, 1988

*Attest:*

DONALD J. QUIGG

*Attesting Officer*

*Commissioner of Patents and Trademarks*